US005717417A

United States Patent [19]

Takahashi

[11] Patent Number: 5,717,417

[45] Date of Patent: Feb. 10, 1998

[54] DOT-MATRIX LED DISPLAY DEVICE HAVING BRIGHTNESS CORRECTION CIRCUIT AND METHOD FOR CORRECTING BRIGHTNESS USING THE CORRECTION CIRCUIT

[75] Inventor: Nozomu Takahashi, Kanagawa-ken, Japan

[73] Assignee: Kabushiki Kaisha Toshiba, Kawasaki, Japan

[21] Appl. No.: 500,321

[22] Filed: Jul. 10, 1995

[30] Foreign Application Priority Data

Jul. 18, 1994 [JP] Japan ..... 6-165337

[51] Int. Cl.[6] ..... G09G 3/32

[52] U.S. Cl. ..... 345/82; 345/147

[58] Field of Search ..... 345/82–83, 39, 345/97, 73, 20, 22, 150, 163, 147, 98; 39/44; 257/89, 82; 315/383; 340/815.01; 348/687, 674

[56] References Cited

U.S. PATENT DOCUMENTS

| | | | |
|---|---|---|---|
| 3,740,570 | 6/1973 | Kaelin et al. | 345/83 |
| 4,733,227 | 3/1988 | Kanema et al. | 345/22 |
| 4,771,278 | 9/1988 | Pooley | 345/147 |
| 4,901,156 | 2/1990 | Yook | 348/687 |
| 5,184,114 | 2/1993 | Brown | 345/83 |
| 5,191,319 | 3/1993 | Kiltz | 345/73 |
| 5,262,698 | 11/1993 | Dunham | 345/147 |
| 5,283,477 | 2/1994 | Shibata | 345/98 |
| 5,426,446 | 6/1995 | Takei et al. | 345/82 |
| 5,486,843 | 1/1996 | Otting et al. | 345/39 |

FOREIGN PATENT DOCUMENTS

| | | |
|---|---|---|
| 2 683 365 | 5/1993 | France . |
| 5273939 | 10/1993 | Japan . |
| 2 176 042 | 12/1986 | United Kingdom . |
| 2 210 720 | 6/1989 | United Kingdom . |

OTHER PUBLICATIONS

Patent Abstracts of Japan, vol. 18, No. 50 (P–1683), Jan. 26, 1994, JP–A–5 273939, Oct. 22, 1993.

*Primary Examiner*—Mark R. Powell

*Attorney, Agent, or Firm*—Oblon, Spivak, McClelland, Maier & Neustadt, P.C.

[57] ABSTRACT

A dot-matrix LED display device has an LED array with a dot matrix of LEDs, a matrix driver unit for driving the LEDs, and a control unit for controlling the matrix driver unit. The display device has a data storage unit for storing brightness-corrected data prepared according to the characteristic brightness of each of the LEDs, selects the brightness-corrected data stored in the data storage unit according to externally provided display data, and drives the LEDs according to the selected brightness-corrected data. This arrangement minimizes brightness difference among the LEDs due to fluctuations in the characteristics of the LEDs.

19 Claims, 8 Drawing Sheets

FIG.4

| CORRESPONDING DOT | ADDRESS | | DATA |
|---|---|---|---|
| | DOT POSITION ON DISPLAY PANEL | 8-BIT INPUT DATA | |
| (1 , 1) | 0000000000000000 | 00000000 | 00000000 |
| (1 , 1) | 0000000000000000 | 00000001 | 00000000 |
| (1 , 1) | 0000000000000000 | 00000010 | 00000001 |
| (1 , 1) | 0000000000000000 | 00000011 | 00000001 |
| (1 , 1) | 0000000000000000 | 00000100 | 00000010 |
| (1 , 1) | 0000000000000000 | 00001101 | 00000000 |
| (1 , 1) | 1100011 | 0 | 0000 |
| | 0111110011 | 01111111 | |
| (19 , 8) | 0011110011 | 10000000 | 01000000 |
| (19 , 8) | 0011110011 | 00000001 | 01000001 |
| (19, 8) | 0011110011 | 00010 | 01000001 |
| (19 | 1111111111111111 | 11111111 | 01000 |
| (32 , 32) | 1111111111111111 | 11111110 | |
| (32 , 32) | 1111111111111111 | 11111111 | |

DOT-MATRIX LED DISPLAY DEVICE HAVING BRIGHTNESS CORRECTION CIRCUIT AND METHOD FOR CORRECTING BRIGHTNESS USING THE CORRECTION CIRCUIT

BACKGROUND OF THE INVENTION

1. Field of the Invention

The present invention relates to a dot-matrix LED display device employing a matrix of LEDs (light emitting diodes) and a method of adjusting the brightness of the LEDs.

2. Description of the Prior Art

Dot-matrix LED display devices among other kinds of display device are relatively long life and easy to provide a large screen panel. Due to these advantages, they are widely used. FIG. 1 is a block diagram showing a dot-matrix LED display device according to a prior art, employing red and green LEDs. An LED array 101 has a matrix of red and green LEDs 101*a* serving as dots. A scan circuit 102 sequentially scans the LEDs 101*a*. A data output circuit 103 drives the LEDs 101*a* in synchronization with the scan timing of the scan circuit 102. A control unit 104 controls the scan circuit 102 and data output circuit 103, to selectively light the LEDs 101*a*.

The control unit 104 receives, from the outside, 8-bit red display data RA to RH, 8-bit green display data GA to GH, clock signals CK1 and CK2, a reset signal RE, a select signal SE, a brightness signal BR, and an oscillation pulse OSC. In response to a control signal from a switch 106, a clock selector 105 selects the clock signal CK1 to achieve a one-phase clock mode or the clock signals CK1 and CK2 to achieve a two-phase clock mode. The output of the clock selector 105 is supplied to a data input control circuit 107, which is connected to a red and a green display data RAM 108, 109. The data input control circuit 107 receives the red and green display data in synchronization with the clock signal CK1 and stores them in the respective RAMs 108 and 109 according to the select signal SE. The outputs of the RAMs 108 and 109 are connected to red and green gradation control circuits 110 and 111, which are connected to the data output circuit 103.

The brightness signal BR adjusts a lighting time between pulses $CK1_n$ and $CK1_{n+1}$ of the clock signal CK1, where n=32·a, a being an integer among 1 to 32. A gradation time detector 112 receives the oscillation pulse OSC and calculates a gradation time by dividing the lighting time by 256. A surface brightness correction circuit 113 operates according to the clock signal CK1 and is controlled by an external switch 114 and an external brightness adjuster 115. Namely, the surface brightness correction circuit 113 provides data for correcting the total brightness of the display panel 101 according to a value set through the brightness adjuster 115. The gradation control circuits 110 and 111 refer to the gradation time provided by the gradation time detector 112 and the data provided by the surface brightness correction circuit 113 and controls the lighting time of each LED to display a color with one of 256 gradation levels according to the display data. The output of the clock selector 105 is also connected to two-stage 4-bit counters 117 and 118 connected in series. The outputs of the two-stage 4-bit counters 118 are connected to a decoder 119, which is connected to the scan circuit 102. The reset signal RE resets the clock selector 105, surface brightness correction circuit 113, and two-stage 4-bit counters 117 and 118.

The characteristics of the LEDs 101*a* differ from one another to cause brightness difference among them. To solve this problem, the prior art carries out selection work to equalize the characteristics of the LEDs 101*a*. This work increases the cost of a display device, in particular, a large-sized display panel comprising a plurality of the LED arrays.

SUMMARY OF THE INVENTION

To solve these problems, an object of the present invention is to provide a dot-matrix LED display device capable of realizing uniform brightness among LEDs and a method of adjusting the brightness of the display device. Another object of the present invention is to provide a dot-matrix LED display device having a simple structure capable of realizing uniform brightness among LEDs.

To achieve the objects, the present invention provides a dot-matrix LED display device shown in FIG. 2. The display device has an LED array 1 containing a matrix of LEDs; a matrix driver unit including a scan circuit 2 for driving the LEDs and a data output circuit 3; and a control unit 4 for controlling the matrix driver unit. What is characteristic to this display device is a brightness correction circuit 60 having a data storage unit for storing brightness-corrected data for each of the LEDs, to minimize brightness difference among the LEDs. The display device selects the brightness-corrected data according to externally provided display data RA to RH and GA to GH and determines the lighting time of each LED according to the selected brightness-corrected data, to thereby minimize brightness difference among the LEDs due to fluctuations in the characteristics of the LEDs.

FIG. 3 shows the details of the brightness correction circuit 60. A ROM 69 stores the brightness-corrected data prepared for each of the LEDs to minimize brightness difference among the LEDs. A RAM 71 holds part of the brightness-corrected data of the ROM 69. When no display data is transferred from the outside, part of the brightness-corrected data is transferred from the ROM 69 to the RAM 71. When display data is externally provided, the brightness-corrected data in the RAM 71 is selected according to the display data, to drive the LEDs. FIG. 7 is a time chart showing the operation of the brightness correction circuit 60, and FIG. 8 is a time chart showing the operation of the display device driven according to the brightness-corrected data. The data in the RAM is periodically refreshed, and the lighting time of each LED is correctly determined according to the brightness-corrected data in the RAM, which operates at a high speed. This display device eliminates the work of selecting LEDs and is capable of minimizing brightness difference among LEDs at low cost and improving a displaying quality.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the invention in practice.

BRIEF DESCRIPTION OF THE DRAWINGS

FIG. 4 shows a format of data stored in a ROM 64 and RAM 67 of the circuit of FIG. 3;

DETAILED DESCRIPTION OF THE EMBODIMENTS

Figure 1:
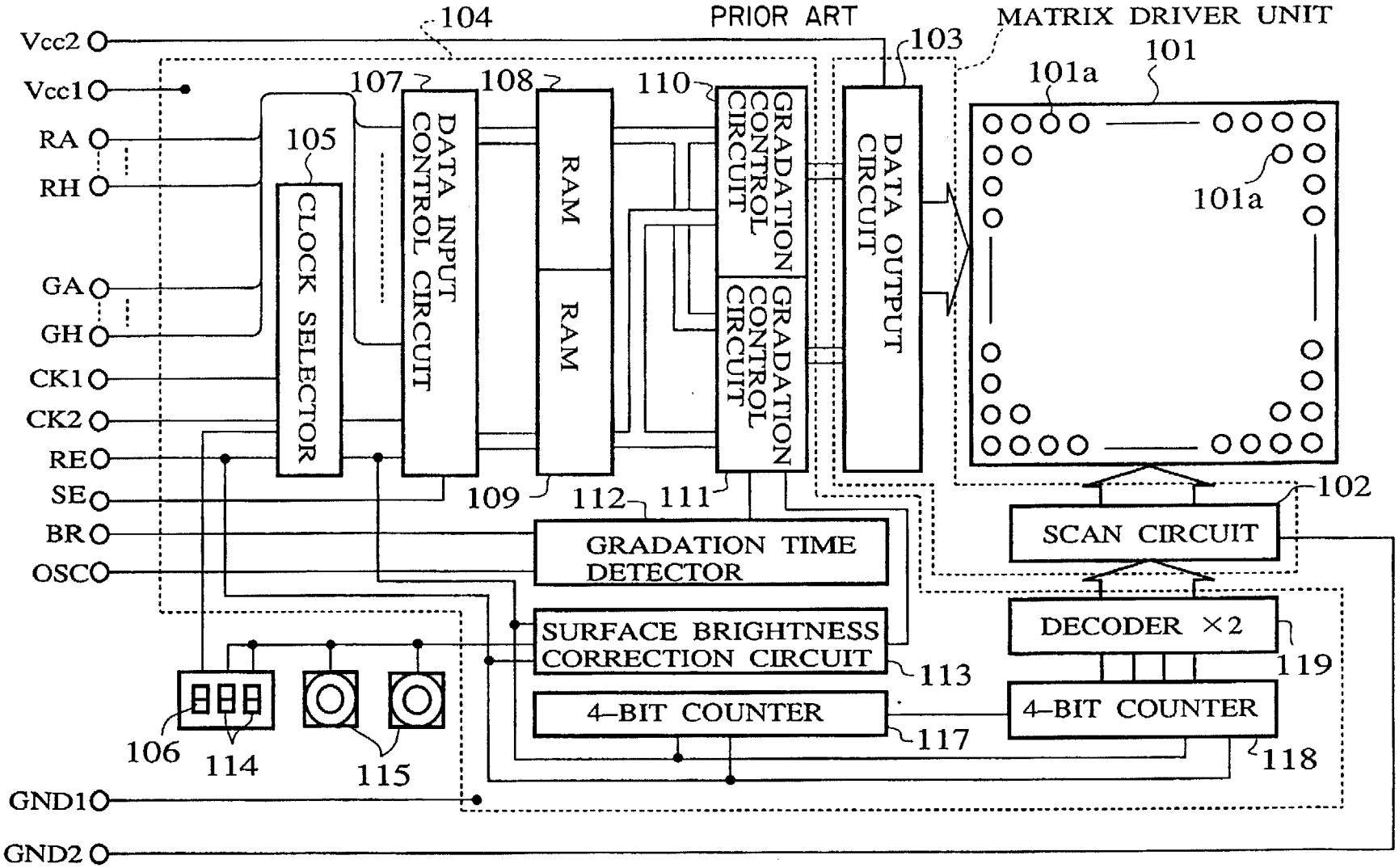
FIG. 1 PRIOR ART
FIG. 1 is a block diagram showing a dot-matrix LED display device according to a prior art.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Figure 2:
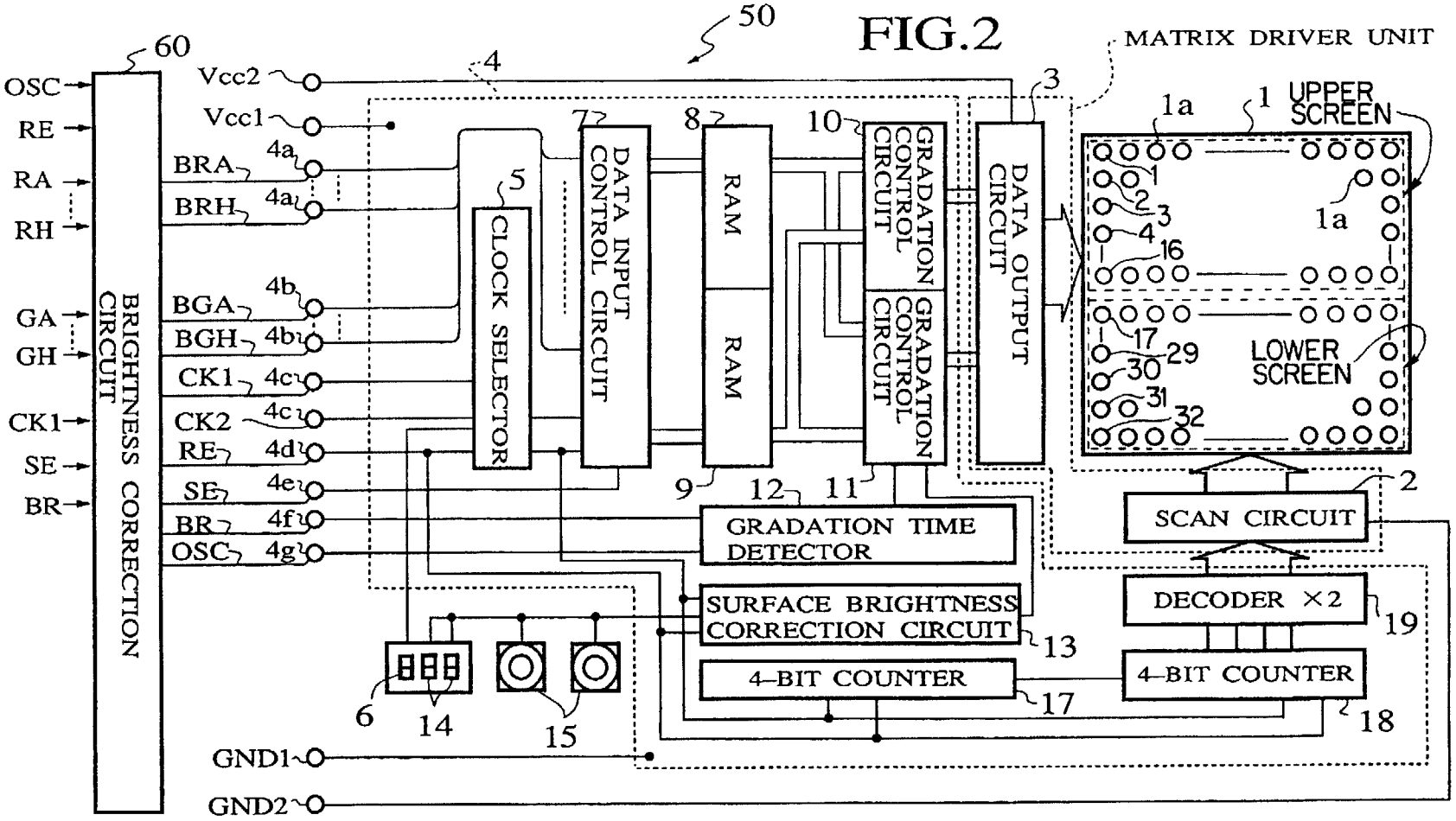
FIG. 2 is a block diagram showing a dot-matrix LED display device according to an embodiment of the present invention.

FIG. 2 is a block diagram showing a dot-matrix LED display device employing red and green LEDs according to an embodiment of the present invention. The display device has a main circuit 50 and a brightness correction circuit 60 connected to an input end of the main circuit 50. The brightness correction circuit 60 corrects the brightness of each of the LEDs that form a display panel 1 of the main circuit 50. The LED array 1 has a matrix of, for example, 32×32 of red and green LEDs 1*a*. The main circuit 50 also has a matrix driver unit and a control unit 4 for controlling the matrix driver unit to selectively light the red and green LEDs 1*a*. The matrix driver unit has a scan circuit 2 for sequentially scanning the LEDs 1*a*, and a data output circuit 3 for driving the LEDs 1*a* in synchronization with the scan timing of the scan circuit 2.

The control unit 4 has input terminals 4*a* for brightness-corrected 8-bit red data BRA to BRH, input terminals 4*b* for brightness-corrected 8-bit green data BGA to BGH, input terminals 4*c* for clock signals CK1 and CK2, an input terminal 4*d* for a reset signal RE, an input terminal 4*e* for a select signal SE, an input terminal 4*f* for a brightness signal BR, and an input terminal 4*g* for an oscillation pulse OSC. These input terminals 4*a* to 4*g* are connected to an output end of the brightness correction circuit 60. The input terminals 4*c* for the clock signals CK1 and CK2 are connected to a clock selector 5. In response to a control signal from a switch 6, the clock selector 5 selects the clock signal CK1 to achieve a one-phase clock mode or the clock signals CK1 and CK2 to achieve a two-phase clock mode. In the following explanation, the one-phase clock mode is mainly described, and the two-phase clock mode is briefly described lastly.

Figure 7:
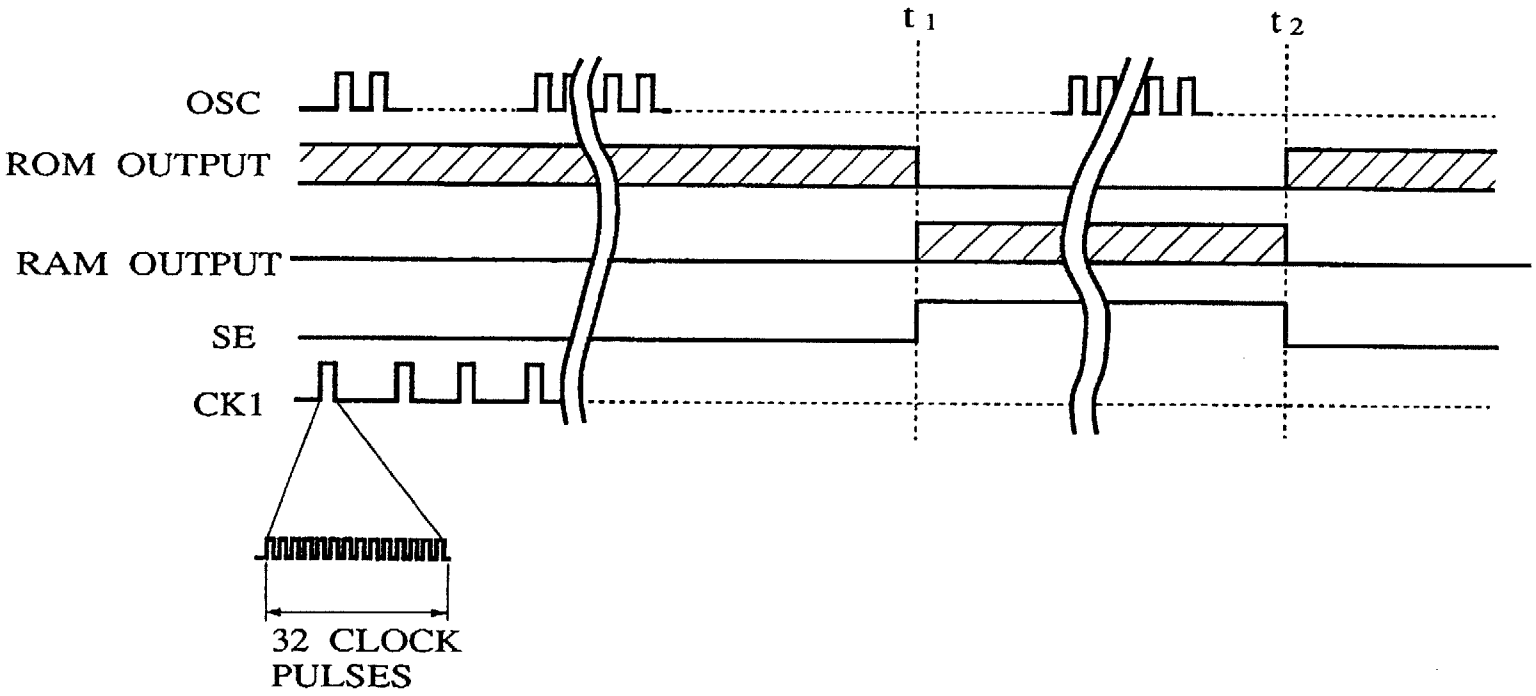
FIG. 7 is a time chart explaining the operation of the brightness correction circuit of FIG. 3.
Figure 8:
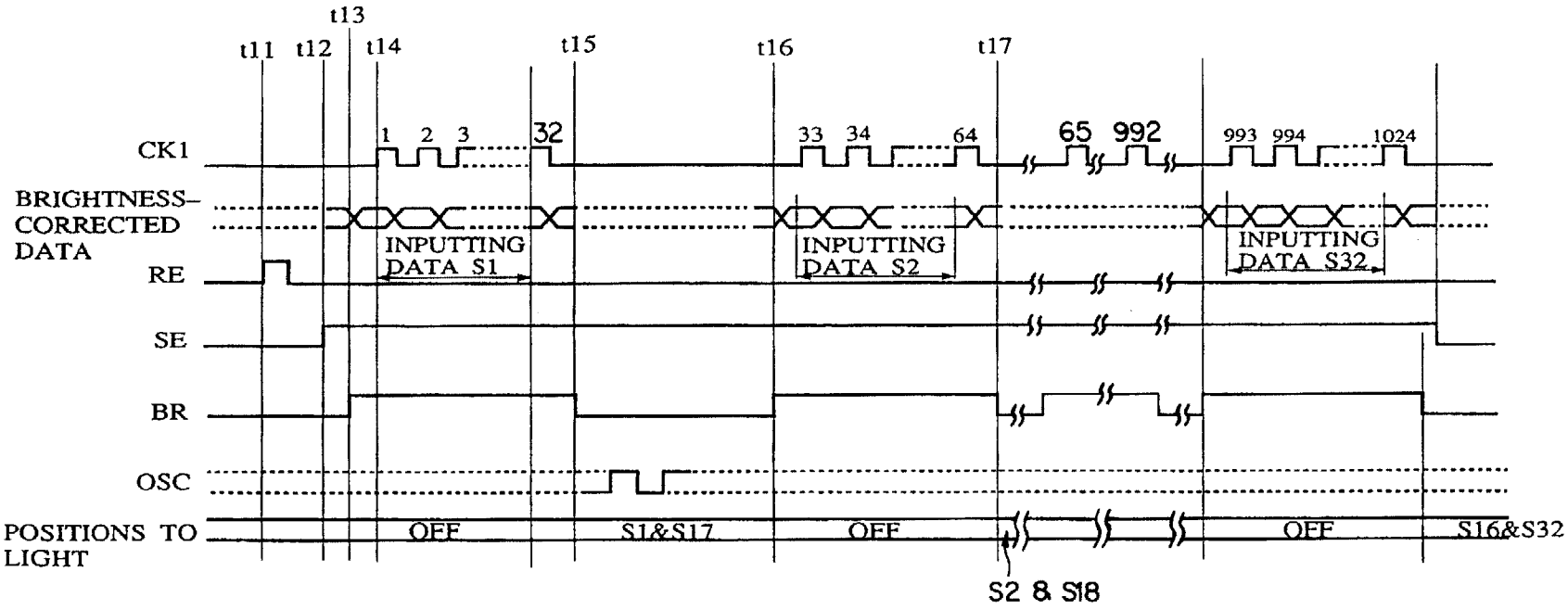
FIG. 8 is a time chart explaining the operation of the display device of FIG. 2.

FIGS. 7 and 8 show the operation of the display device. The clock signal CK1 provides pulse groups each containing 32 pulses. An interval between the last pulse of a given pulse group and the first pulse of the next pulse group defines a lighting time. Each scanning operation covers 16 LEDs. The timing charts of FIGS. 7 and 8 will be explained later in detail. Returning to FIG. 2, the LED array 1 is divided into an upper screen and a lower screen. The upper screen includes the first to 16th rows of the LED matrix, and the lower screen includes the 17th to 32nd rows thereof. The rows of LEDs are scanned one after another in each of the upper and lower screens. Each scanning operation is carried out on 16 LEDs, i.e., every LED in each row is scanned in synchronization with the clock signal CK1. This means that each row of the LED array 1 is lighted once per 16 scanning operations, i.e., at a duty factor of 1/16. A row x (x being one of 1to 16) in the display panel 1 is lighted between pulses n and n+1 of the clock signal CK1, in which n is expressed as follows:

$$n=32\cdot(16\cdot a+x)$$

where a is one of 0 to "N−1" and N is the number of scanning operations necessary for refreshing the LED array 1 once. As shown in FIG. 8, a displaying operation is carried out between pulses n and n+1 of the clock signal CK1. Namely, a displaying operation is carried out between pulses 32 and 33, between pulses 64 and 65, . . . . and between pulses 992 and 993 of the clock signal CK1.

The output of the clock selector 5 is connected to a data input control circuit 7, which is connected to brightness-corrected red and green data RAMs 8 and 9. The data input control circuit 7 is connected to the brightness data input terminals 4*a* and 4*b* and select signal input terminal 4*e*. The data input control circuit 7 receives brightness-corrected red and green data in synchronization with the clock signal CK1, and provides the RAMs 8 and 9 with the respective brightness-corrected data when the select signal SE is at high level H. The outputs of the RAMs 8 and 9 are connected to gradation control circuits 10 and 11, which are connected to the data output circuit 3.

The brightness signal input terminal 4*f* and oscillation pulse input terminal 4*g* are connected to a gradation time detector 12. The brightness signal BR is used to further adjust a lighting time between pulses n and n+1 of the clock signal CK1. The gradation time detector 12 receives the oscillation pulse OSC, divides the lighting time by 256 according to the brightness signal, and calculates a gradation time. An external switch 14 and brightness adjuster 15 are used to control a surface brightness correction circuit 18. According to a value set through the brightness adjuster 15, the surface brightness correction circuit 13 provides data to correct the total brightness of the LED array 1. The gradation control circuits 10 and 11 refer to the gradation time from the gradation time detector 12 and the data from the surface brightness correction circuit 13, to control the lighting time of each LED so that the LED may display one of 256 gradation levels according to the brightness-corrected data.

The output of the clock selector 5 is connected to a two-stage 4-bit counter 17 and a two-stage 4-bit counter 18 connected in series. The outputs of the two-stage 4-bit counter 18 are connected to a two-stage decoder 19, which is connected to the scan circuit 2. The reset signal input terminal 4*d* is connected to the clock selector 5, surface brightness correction circuit 13, and 4-bit counters 17 and 18 so that the reset signal RE may reset these circuits. The control unit 4 has a power source terminal Vcc1 and a ground terminal GND1, and a matrix driver unit has a power source terminal Vcc2 and a ground terminal GND2.

Figure 3:
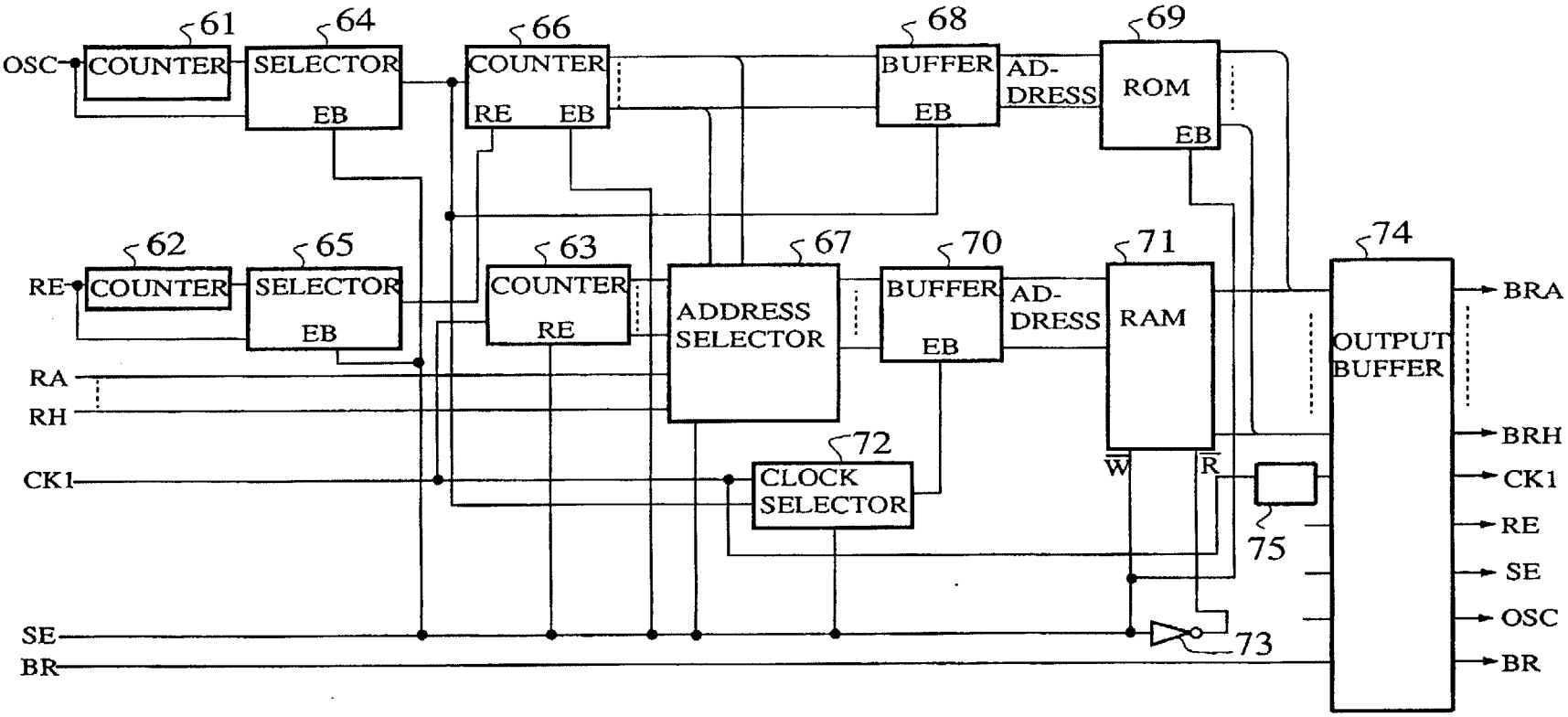
FIG. 3 is a block diagram showing a brightness correction circuit 60 of the display device of FIG. 2, the circuit 60 being for blue LEDs and a brightness correction circuit for red LEDs being not shown for the sake of simplicity of the drawing.

FIG. 3 is a block diagram showing the details of the brightness correction circuit 60. This circuit is for red LEDs. For the sake of simplicity of explanation, a brightness correction circuit for green LEDs is omitted. Accordingly, the circuit 60 of FIG. 3 receives only external red display data RA to RH. The brightness correction circuit 60 has a counter 61 for counting the number of the oscillation pulses OSC, a counter 62 for counting the reset signals RE, and a counter 63 for counting pulses of the clock signal CK1. The counters 61 and 62 are connected to selectors 64 and 65, respectively. The selector 64 selects the output of the counter 61 or the oscillation pulse OSC according to the select signal SE. The selector 65 selects the output of the counter 62 or the reset signal RE according to the select signal SE. The output of the selector 64 is connected to the counter 66, and the output of the selector 65 is supplied as a reset signal to the counter 66. The output of the counter 66 is supplied to an input terminal of an address selector 67, and as an address of the R0M 69 to store brightness-corrected data, to the buffer 68.

Ten-bit output data of the counter 63 and the external 8-bit gradation data, i.e., red display data RA to RH are supplied to the other input terminal of the address selector 67. The output of the address selector 67 is supplied as an address of a RAM 71 to a buffer 70. The output of the selector 64 is supplied to the buffer 68 and a clock selector 72. If the output of the selector 64 is selected by the clock selector 72, it will be an enable signal EB to the buffer 70. The clock selector 72 also receives the clock signal CK1. If the clock signal CK1 is selected by the clock selector 72, it will be an enable signal EB to the buffer 70.

The select signal SE controls the data output of the counters 66 and 63, the selection operation of the address selector 67, the selection operation of the clock selector 72, the read (R)/write (W) operation of the RAM 71, and the read operation of the ROM 69. A read terminal of the RAM 71 receives the select signal SE through an inverter 73. The counter 63 is reset by the select signal SE. The output side of the ROM 69 is connected to the input/output side of the RAM 71. The brightness-corrected data from the RAM 71 is sent to the input terminals **4*a* of the main circuit 50 through an output buffer 74. The clock signal CK1 is passed through a buffer 75 and the output buffer 74 and is supplied to the input terminal 4*c* of the main circuit 50. The reset signal RE, select signal SE, brightness signal BR, and oscillation pulse OSC are supplied to the input terminals 4*d*, 4*e*, 4*f*, and 4*g*, respectively, through the output buffer 74**.

FIG. 4 shows a format of data stored in the ROM 69 and RAM 71. The ROM 69 stores the brightness-corrected data of each LED at a corresponding address. The address of each LED is 10-bit data (=32×32 LEDs), and the brightness (gradation) data of each LED is 8-bit data, as shown in FIG. 4. According to this embodiment, the ROM 69 and RAM 71 employing the format of FIG. 4 are required for each of red and green LED groups.

Figure 5:
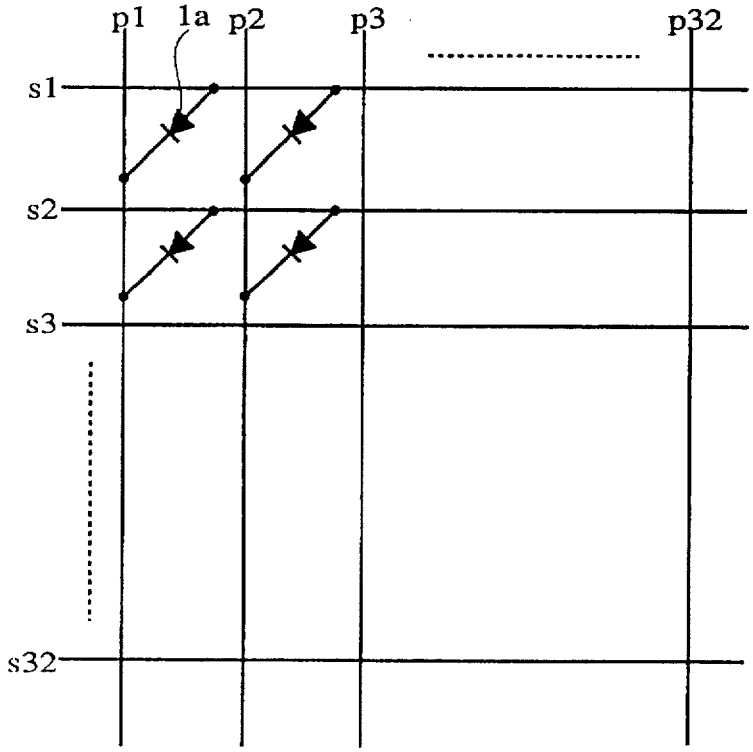
FIG. 5 shows the details of a display panel 1 of the display device of FIG. 2.

FIG. 5 shows the detail of the LED array 1 of FIG. 2. The display panel 1 has a matrix of 32 data lines s1 to s32 and 32 scan lines p1 to p32 with the LEDs **1*a* being connected to the intersections of the data and scan lines. Two sets (not shown) of the matrix of 32 data lines and 32 scan lines of FIG. 5** are arranged for the red and green LED groups, respectively.

Figure 6A:
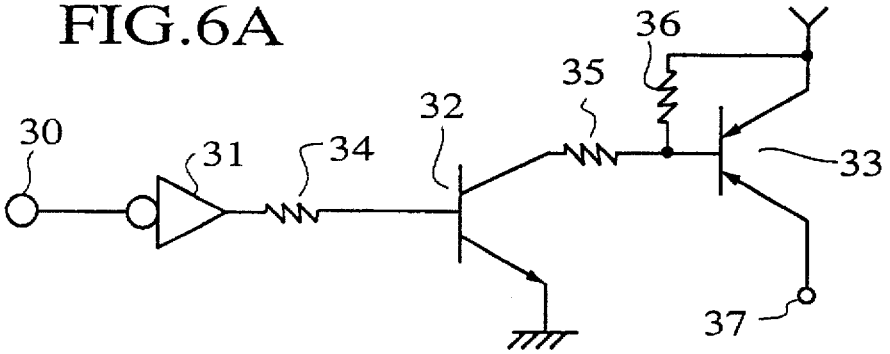
FIG. 6A shows a data output circuit 3 of the display device of FIG. 2
Figure 6B:
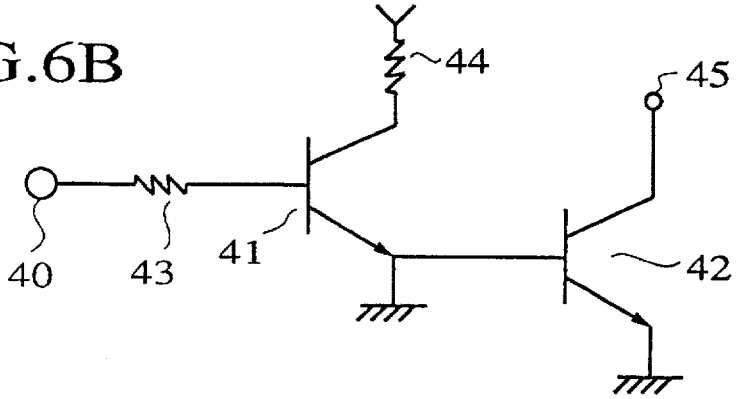
FIG. 6*b* shows a scan circuit 2 of the display device of FIG. 2.

FIG. 6A shows a unit structure of the data output circuit 3 and FIG. 6B shows a unit structure of the scan circuit 2 of FIG. 2. The unit data output circuit 3 of FIG. 6A has an input inverter 31, two bipolar transistors 32 and 33, and resistors 34, 35, and 36. This unit structure is for one data line. Namely, there are 32 unit structures for the 32 data lines. When an input terminal 30 receives display data of low level, the output of the inverter 31 supplies a base current to the NPN transistor 32 through the resistor 34, to turn ON the NPN transistor 32. As a result, a current from a power source flows through the resistors 36 and 35 and NPN transistor 32, to turn ON the PNP transistor 33. Then, an output terminal 37 connected to, for example, the data line s1 of the LED array 1 becomes high level, to activate the data line s1.

The unit scan circuit 2 of FIG. 6B has two bipolar transistors 41 and 42 and two resistors 43 and 44. This unit structure is for one scan line. Namely, there are 32 unit structures for the 32 scan lines. When an input terminal 40 receives a signal of high level, a base current is supplied to the NPN transistor 41 through the resistor 43, to turn ON the NPN transistor 41. As a result, a current from a power source flows through the resistor 44 and NPN transistor 41 to the base of the NPN transistor 42, to turn ON the NPN transistor 42. Then, an output terminal 45 connected to, for example, the scan line p1 of the LED array 1 becomes low level, to activate the scan line pl. Consequently, the LED **1*a*** connected to the data line s1 and scan line p1 emits light.

The operation of the dot-matrix LED display device and a method of adjusting the brightness of the same will be explained with reference to the time charts of FIGS. 7 and 8. The brightness of each LED of the LED array 1 is measured by a brightness measurement device, and according to the measured brightness, brightness-corrected data to minimize brightness difference among LEDs is prepared for every LED of the LED array 1. The prepared brightness-corrected data is stored in the ROM 69 in the format of FIG. 4.

The operation of the brightness correction circuit 60 will be explained with reference to the time chart of FIG. 7.

The clock signal CK1 according to the embodiment intermittently provides 32 pulse groups each containing 32 pulses. Namely, the clock signal CK1 repeatedly provides 1024 (=32×32) pulses. When the select signal SE Is being at low level up to time t1, the address selector 67 selects the counter 66, the clock selector 72 selects the output of the selector 64, the RAM 71 is put in a write mode, and the counter 66 and ROM 69 are enabled. As a result, the output of the counter 66 is supplied as an address of the R0M 69 to the buffer 68, to transfer corresponding brightness-corrected data from the ROM 69 to the RAM 71. When the select signal SE becomes high level after the time t1, the counter 66 is stopped, the address selector 67 selects the counter 63 and display data RA to RH, the clock selector 72 selects the clock signal CK1, and the RAM 71 is put in a read mode. As a result, the brightness-corrected data stored in the RAM 71 addressed by the 18-bit output data of the address selector 67 is sent to the input terminals **4*a* of the main circuit 50** in synchronization with the clock signal CK1. This operation is continued up to time t2 up to which the select signal SE is kept at high level.

FIG. 8 shows the displaying operation of the main circuit 50 while the select signal SE is being at high level. The brightness-corrected data BRA to BRH and BGA to BGH are supplied to the input terminals **4*a* and 4*b* of the main circuit 50. A pulse of the reset signal RE is supplied at time t11, and the select signal SE and brightness signal BR successively become high level at time t12 and t13. At time t14, a first pulse of a first pulse group of the clock signal CK1 rises. In synchronization with 32 pulses of the first pulse group of the clock signal CK1, brightness-corrected data S1 for 32 LEDs in the first row of the display panel 1 is stored in the RAMs 8 and 9 through the data input control circuit 7**. While the brightness signal BR is being at high level from time to t15, the displaying operation is OFF.

Thereafter, the brightness signal BR is kept at low level from time t15 to t16 during which the brightness-corrected data S1 stored this scanning operation is read for 16 LEDs in the first row of the LED array 1, and brightness-corrected data S17 stored at the previous scanning operation is read for 16 LEDs in the 17th row of the LED array 1, out of the RAMs 8 and 9. The read data are supplied to the gradation control circuits 10 and 11. The gradation control circuits 10 and 11 determine the lighting time of each of these LEDs in the first and 17th rows according to the read brightness-corrected data S1 and S17, a gradation time divided by 256 provided by the gradation time detector 12, and data from the surface brightness correction circuit 13. Then, these LEDs are lighted at specified gradation levels.

During a period between time t16 and t17, the same process as that in the period between time t14 and t15 is carried out, and brightness-corrected data S2 for the second row of the LED array 1 is read. In the next period up to time t18, the brightness-corrected data S2 for the second row and brightness-corrected data S18 for the 18th row are used to display each 16 LEDs in the second and 18th rows, similar to the period between time t15 and t16. In this way, brightness-corrected data S3 to S32 for the third to 32nd rows are read, and each 16 LEDs of the upper and lower screens of the display panel 1 are lighted.

To transfer the brightness-corrected data from the ROM 69 to the RAM 71, $2^{18}$ pulses of the clock signal CK1 are needed. In this case, $2^{18}$ is nearly equal to $262^k$. If a standard VGA (Video Graphic Adaptor) mode (640×480 dots) for a CRT is employed for the dot-matrix LED display device of this embodiment, the frequency of the clock signal CK1 will be about 25 MHz. According to the VGA mode, the number of dot clock pulses between pulses of a horizontal synchronous signal is 800, and the number of pulses of the horizontal synchronous signal between pulses of a vertical synchronous signal is 525. Accordingly, if the frequency of the oscillation pulse OSC is about 10 MHz, the following expression is made:

$$800\times525=420000=420^k$$

Since one screen involves $420^k$ pulses, the brightness-corrected data in the RAM may be refreshed once per two frames. If the frequency of the oscillation pulse OSC is equal to the frequency of the clock signal CK1, the data in the RAM may be refreshed every screen.

In this way, the embodiment of the present invention provides brightness-corrected data from the RAM while the select signal SE being at high level. Namely, the RAM provides corresponding brightness-corrected data according to an address of display data, and the LEDs on the LED array are driven according to the brightness-corrected data. The lighting time of each LED on the LED array is determined according to the brightness-corrected data that is specified by the address of the LED. Even if there is brightness difference among LEDs of an LED array due to fluctuations in the characteristics of the LEDs, the present invention prepares brightness-corrected data for the LEDs to minimize the brightness differences. The brightness-corrected data is read according to externally provided display data. With this arrangement, the display device will be of low cost and high quality.

The present invention is not limited to the embodiment mentioned above. Various modifications are possible over the embodiment. For example, instead of red and green LEDs, red, green, and blue LEDs may be employed to display a full-color image on the display device. The full-color display device comprises matrixes of AlGaAs red LEDs, GaP or InGaAlP green LEDs, GaN or ZnSe blue LEDs. The main circuit 50 shown in FIG. 2 may have a matrix driver unit and a control unit 4 for selectively light the red, green and blue LEDs. The control unit 4 shown in FIG. 2 may have input terminals for brightness-corrected 8-bit red data BRA to BRH, input terminals 4b for brightness-corrected 8-bit green data BGA to BGH, and input terminals 4z for brightness-corrected 8-bit blue data BBA to BBH. And the full-color display device include the brightness correction circuits 60 for red, green and blue LEDs. As to FIG. 5, three sets of the matrix are arranged for the red, green and blue LED groups, respectively. And the brightness-corrected data BRA to BRH, BGA to BGH and BBA to BBH are supplied to the input terminals of the main circuit 50 shown in FIG. 2. The brightness-corrected red, green and blue data are stored in the RAM 71 of FIG. 3 and transferred to the RAMs 8 and 9.

In the above embodiment, brightness-corrected data is stored in the RAM 71 of FIG. 3 firstly, and when the select signal SE is at high level, the brightness-corrected data is transferred from the RAM 71 to the RAMs 8 and 9 of FIG. 2. Instead, the RAM 71 may hold display data, which is always provided as an address for the RAMs 8 and 9, which store the brightness-corrected data.

The brightness-corrected data may be converted into an analog voltage, which is supplied to the input terminal 30 of the data output circuit 3 to drive the LEDs.

Figure 9:
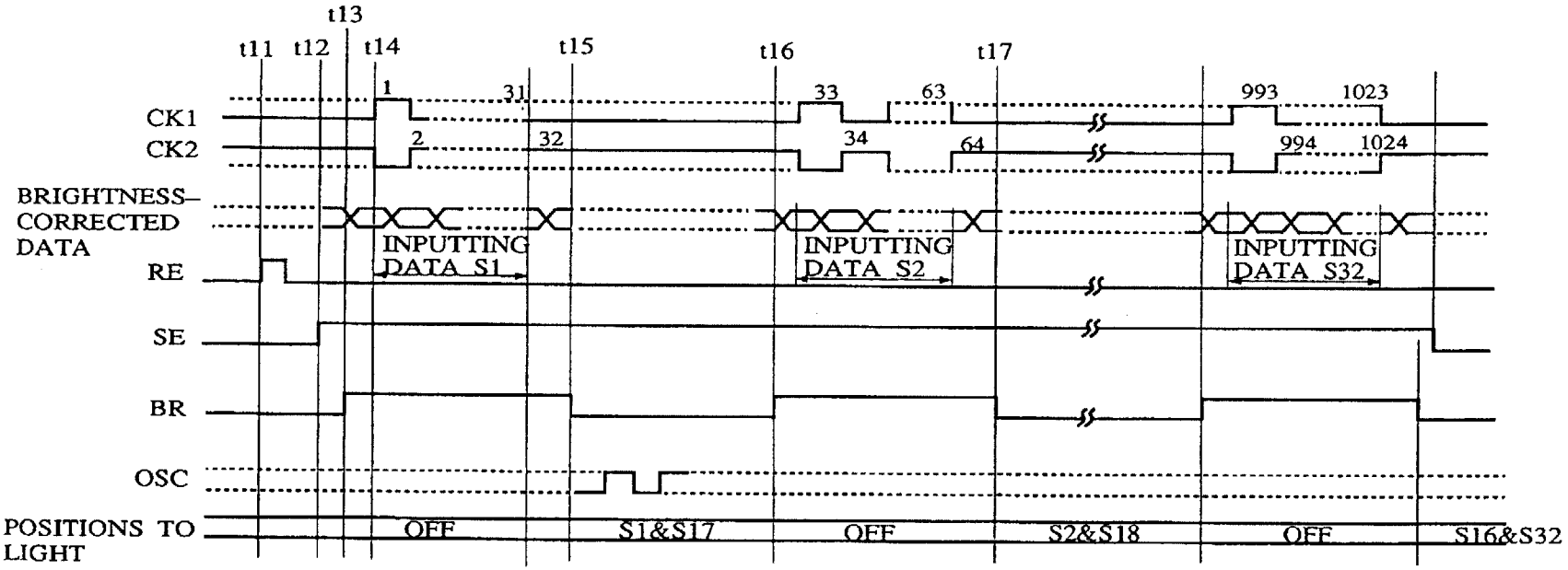
FIG. 9 is a time chart explaining the operation of the display device under a two-phase clock mode.

The above explanation has been made for the one-phase clock mode. The two-phase clock mode will be carried out similarly according to a time chart shown in FIG. 9. By the two-phase clock mode, the faster scanning operation is possible than the one-phase clock mode. The one-phase clock mode and two-phase clock mode are switched from one to another by providing the clock selector 5 of FIG. 2 with a control signal from the switch 6.

What is claimed is:

1. A light emitting diode display device comprising at least one dot matrix array of light emitting diodes, a dot matrix array driver unit for driving the light emitting diodes in the at least one dot matrix array, a control unit for controlling the dot matrix array driver unit, and a brightness correction circuit for storing brightness-corrected data for each of the light emitting diodes in the at least one dot matrix array to minimize brightness difference among the light emitting diodes in the at least one dot matrix array, the brightness correction circuit comprising:

a selector control circuit selecting brightness-corrected data for each of the light emitting diodes in the at least one dot matrix array in response to selection signals at least in part derived from externally provided display data;

a read only memory for storing the brightness-corrected data; and a random access memory directly connected to the read only memory so that at least a portion of the brightness-corrected data is directly transferred from the read only memory to the random access memory responsive to the selector control circuit.

2. The device as claimed in claim 1, wherein the externally provided display data is gradation data including a plurality of bits.

3. The device as claimed in claim 1, wherein the control unit includes a gradation time detection circuit calculating a gradation time and a surface brightness correction circuit providing surface brightness data, said control unit determining a lighting time for each light emitting diode in the at least one dot matrix array according to the gradation time, surface brightness data and the brightness-corrected data transferred from the random access memory.

4. The device as claimed in claim 1 wherein said at least one light emitting diode dot matrix array includes dot matrix arrays of red,green and blue light emitting diodes and said brightness correction circuit includes a red brightness-corrected data circuit portion, a green brightness-corrected data circuit portion and a blue brightness-corrected data circuit portion so that red, green and blue brightness-corrected data is provided to the control unit from each data circuit portion.

5. A light emitting diode display device comprising:

at least one light emitting diode dot matrix array;

a dot matrix array driver unit for driving the light emitting diodes in the at least one dot matrix array;

a control unit for controlling the dot matrix array driver unit;

a selecting control circuit;

a read only memory for storing brightness-corrected data prepared according to a characteristic brightness of each of the light emitting diodes in the at least one dot matrix array to minimize brightness differences among the light emitting diodes in the at least one dot matrix array;

a random access memory directly connected to said read only memory storing at least a transferred portion of the brightness-corrected data held in said read only memory; and an output buffer connected between said random access memory and said control unit, wherein the transferred portion of the brightness-corrected data is directly transferred from said read only memory to said random access memory under control of said selecting control circuit during non-data intervals in display data being externally provided, and the transferred portion of the brightness-corrected data stored in said random access memory is selected under control of the selection control circuit to provide the transferred portion of the brightness-corrected data to the output buffer for further transfer to the control unit.

6. The device as claimed in claim 5, wherein the externally provided display data is gradation data including a plurality of bits.

7. The device as claimed in claim 5, wherein the control unit includes a gradation time detection circuit calculating a gradation time and a surface brightness correction circuit providing surface brightness data, said control unit determining a light time for each light emitting diode in the at least one dot matrix array according to the gradation time, surface brightness data and the brightness-corrected data transferred from the random access memory.

8. The device as claimed in claim 5, wherein said at least one light emitting diode dot matrix array includes dot matrix arrays of red, green and blue light emitting diodes and brightness-corrected red, green and blue data is transferred from said read only memory to said random access memory.

9. A light emitting diode display device comprising:

at least one light emitting dot matrix array;

a dot matrix array driver unit for driving the light emitting diodes in the at least one dot matrix array;

control unit having a first random access memory for holding data to control the dot matrix array driver unit;

a selecting control circuit;

read only memory for storing brightness-corrected data prepared according to a characteristic brightness of each of the light emitting diodes in the at least one dot matrix array to minimize brightness differences among the light emitting diodes;

a second random access memory directly connected to said read only memory and addressed using the selection control circuit to provide output brightness-corrected data; and an output buffer connected between said random access memory and said control unit, wherein at least a portion of the brightness-corrected data is directly transferred from said read only memory to said second random access memory by said selecting control circuit during non-data intervals in display data being externally provided, and the the transferred portion of the brightness-corrected data stored in said second random access memory is selected by the selection control circuit to provide the brightness-corrected output data to the output buffer for coupling to the first random access memory included in the control unit.

10. The device as claimed in claim 9, wherein the externally provided display data is gradation data including a plurality of bits.

11. The device as claimed in claim 9, wherein the control unit includes a gradation time detection circuit calculating a gradation time and a surface brightness correction circuit providing surface brightness data, said control unit determining a lighting time for each light emitting diode in the at least one dot matrix array according to the gradation time, surface brightness data and the brightness-corrected output data in the first random access memory.

12. The device as claimed in claim 9, wherein said at least one light emitting diode dot matrix array includes dot matrix arrays of red, green and blue light emitting diodes and brightness-corrected red, green and blue data is transferred from said read only memory to said second random access memory, and said first random access memory stores output brightness-corrected red, green and blue data to control the dot matrix array driver unit.

13. A method for controlling the brightness of a light emitting diode display device having a light emitting diode dot matrix array, a dot matrix driver array unit for driving the light emitting diodes, and a control unit for controlling the matrix driver unit, said method comprising:

preparing brightness-corrected data according to the characteristic brightness of each of the light emitting diodes to minimize brightness differences among the light emitting diodes in a particular dot matrix array;

storing the brightness-corrected data in a read only memory disposed outside of the control unit:

directly transferring at least a portion of the brightness-corrected data from the read only memory to a random access memory disposed outside the control unit for a period of time corresponding to a non-data interval in display data being provided externally;

selecting the transferred portion of the brightness-corrected data stored in the random access memory at least in part based upon characteristics of the externally provided display data; and driving the light emissive diodes in the dot matrix array according to the selected brightness-corrected data.

14. The method as claimed in claim 13, wherein said light emissive diode dot matrix array includes individual dot sub-matrixes of red, green and blue light emitting diodes and wherein the preparing brightness-corrected data step includes preparing brightness-corrected red data, brightness-corrected green data and brightness-corrected blue data;

storing the brightness-corrected data step includes storing brightness-corrected red data, brightness-corrected green data and brightness-corrected blue data; and the directly transferring a portion of the brightness-corrected data step includes directly transferring a portion of each of the brightness-corrected red, green and blue data.

15. The device as claimed in claim 1, wherein the selector control circuit in the brightness correction circuit further comprises:

a first counter for counting a number of oscillator pulses;

a second counter for counting pulses of a reset signal;

a third counter for counting pulses of a clock signal;

a first selector connected to the first counter;

a second selector connected to the second counter;

a fourth counter connected to the first selector;

an address selector having an input for receiving said externally provided display data and input terminals connected to the third and fourth counters;

a first buffer connected between the fourth counter and said read only memory;

a second buffer connected between the address selector and said random access memory; and a clock selector for providing an enable signal to the second buffer.

16. The device as claimed in claim 15, further comprising:

a control signal circuit;

wherein a select signal having a high level and a low level is provided to the first and second selectors, the third and fourth counters, the address selectors the read only memory, the random access memory and the clock selector by the control signal circuit.

17. A device as claimed in claim 16, wherein, for the time period that the select signal is at the low level, the selector control circuit places said random access memory in a write mode.

18. A device as claimed in claim 16, wherein, for the time period that the select signal is at a high level, the selector control circuit provides a clock signal and places said random access memory in a read mode.

19. A device as claimed in claim 18, wherein the brightness-corrected data stored in said random access memory is provided to said control unit in synchronization with the clock signal through an output buffer connected between said random access memory and said control unit under control of the selector control circuit.

* * * * *